US005816489A

United States Patent [19]

Stockman

[11] Patent Number: 5,816,489

[45] Date of Patent: Oct. 6, 1998

[54] MAILBOX WITH VISUAL INDICATOR

[76] Inventor: Emanuel Soloman Stockman, 14720 Maine Cove Ter., N. Potomac, Md. 20878

[21] Appl. No.: 456,319

[22] Filed: Jun. 1, 1995

[51] Int. Cl.[6] ..... B65D 91/00

[52] U.S. Cl. ..... 232/35

[58] Field of Search ..... 232/34, 35, 17; D99/29

[56] References Cited

U.S. PATENT DOCUMENTS

| | | | |
|---|---|---|---|
| 1,451,876 | 4/1923 | Jewett | 232/35 |
| 3,391,861 | 7/1968 | Seckler | 232/35 |
| 3,482,543 | 12/1969 | Guidos . | |
| 3,516,383 | 6/1970 | Goodman . | |
| 4,113,170 | 9/1978 | Hunsicker | 232/35 |
| 4,138,056 | 2/1979 | Sherrill . | |
| 4,524,905 | 6/1985 | Crist | 232/35 |
| 4,685,612 | 8/1987 | Rascov | 232/35 |
| 4,711,391 | 12/1987 | Roge et al. | 232/35 |
| 4,728,028 | 3/1988 | Barnes et al. . | |
| 4,896,624 | 1/1990 | Carnwath . | |
| 5,076,337 | 12/1991 | Reuter . | |
| 5,123,590 | 6/1992 | Teele . | |
| 5,366,148 | 11/1994 | Schreckengost . | |

OTHER PUBLICATIONS

Creative Solutions, "A collection of practical products for the home", Mail Time Flag.

*Primary Examiner*—Kenneth J. Dorner
*Assistant Examiner*—Jerry Redman
*Attorney, Agent, or Firm*—Baker & Botts

[57] ABSTRACT

A combination of a mail box and visual indicator is disclosed. The combination includes a mailbox having front and rear ends and an elongated resilient member having first and second ends. The elongated member is mounted at its first end to the rear end of the mailbox and has a tip protector mounted at its second end. When the door to the mailbox is open, the elongated member swings from an engaged to an extended position so as to indicate the door has been opened and the mail has arrived. The tip protector prevents injury to persons in the vicinity of the box while the elongated member is in motion.

16 Claims, 6 Drawing Sheets

17
10
15
VL
14
L
11
12
14
17
18
13
16
18
D

MAILBOX WITH VISUAL INDICATOR

BACKGROUND

FIELD OF THE INVENTION

This invention relates generally to mailboxes. More specifically this invention relates to mailboxes which provide a visual indication of the arrival of the mail.

BACKGROUND OF THE INVENTION

In areas where houses are spaced far apart and set back from the street, such as rural areas, it is common to have the mailbox for a particular house located along the side of the road on which the house "fronts" as opposed to at or near the door of the house. This creates a problem in that it is difficult to determine whether or not the mail has arrived, apart from actually seeing the mail carrier deposit the mail or by wailing to the mailbox. Neither of these methods is very practical or time efficient.

Most of these rural mailboxes are equipped with an official mail flag. However, the function of this mail flag is not to inform the mailbox owner when the mail has arrived. Rather, it's function is to inform the mail carrier that there is outgoing mail in the box. Therefore, it is desirable to have some type of visual signal attached to a mail box in order to inform its owner that the mail has arrived.

Past attempts to incorporate visual signals on mail boxes have had associated problems. One problem has been inadequate safety measures for the mail carrier and users of the box. Some of these devices employ some type of visual signal mounted on a rod. The rod is mounted on the mailbox so that when the mail box door is opened, the rod may release from a horizontal position and swing up to a vertical position. The rods may be metal or plastic and could possibly have sharp ends. During the release, the swinging of such a rod could cause serious cuts to anyone standing in its path.

Additionally, past attempts to provide mail boxes with visual signals have resulted in signals which were not highly visible. One reason for this was the use of a relatively short rod for the visual signal. The size of the rod is limited by its position on the mailbox, by the material used for the rod, and the size of the mailbox. Nevertheless, the shortness of the rod provided a signal which was not adequately visible.

SUMMARY OF THE INVENTION

The inventor has recognized a need for a mailbox with a safe and highly visible visual signal.

It is an object of the present invention to provide a mailbox with a visual signal which operates safely and is highly visible.

It is another object of the present invention to provide time savings and convenience to the owner of a mailbox by allowing the owner to know whether or not mail has arrived without having to watch for the mail carrier or walk to the mailbox.

In an embodiment, the invention comprises a system for visually indicating the delivery of mail. The system includes a container for holding mail which has an open front end, an enclosed rear end, a depth and at least one side. The front end of the container has a door to cover the opening. A resilient elongated member which is straight in an unstressed state and having a first end and a second end is mounted to the container adjacent the container's rear end. The unstressed state, as used herein, refers to the absence of any force acting on the member. A visual indicator, e.g. a flag, is mounted adjacent the second end of the elongated member. The elongated member is disposed in either an engaged position (where a force is applied so that the member is substantially parallel to the depth of the container) or an extended position (where the member is in its unstressed, straight configuration so as to be substantially perpendicular to the depth of the container). An engagement member mounted on the door holds the second end when the elongated member is in the engaged position and thereby restrains the elongated member from returning to its unstressed straight position from its engaged position. In operation, when the door of the container is opened, the engagement member moves, with the door, away from the container, causing the second end of the elongated member to slip from the hold of the engagement member. Consequently, the elongated member returns to its unstressed state and swings to the extended position allowing the visual signal to be readily viewed from a distance. A tip protector is affixed to the second end of the elongated member and provides a blunt end to said elongated member thereby preventing the second end of the elongated member from injuring the mail carrier or passersby when it swings from the engaged position to the extended position or from injuring the owner when placing the elongated member into the engaged position.

Other objects, features and advantages of the present invention will be apparent when the detailed description is considered along with the drawings.

DETAILED DESCRIPTION

An embodiment of the present invention utilizes a visual signal for communicating to a mailbox owner that mail has been delivered. The invention provides time savings and convenience to the owner of a mailbox by allowing the owner to know whether or not mail has arrived without having to watch for the mail carrier or walk to the mailbox.

Figure 1:
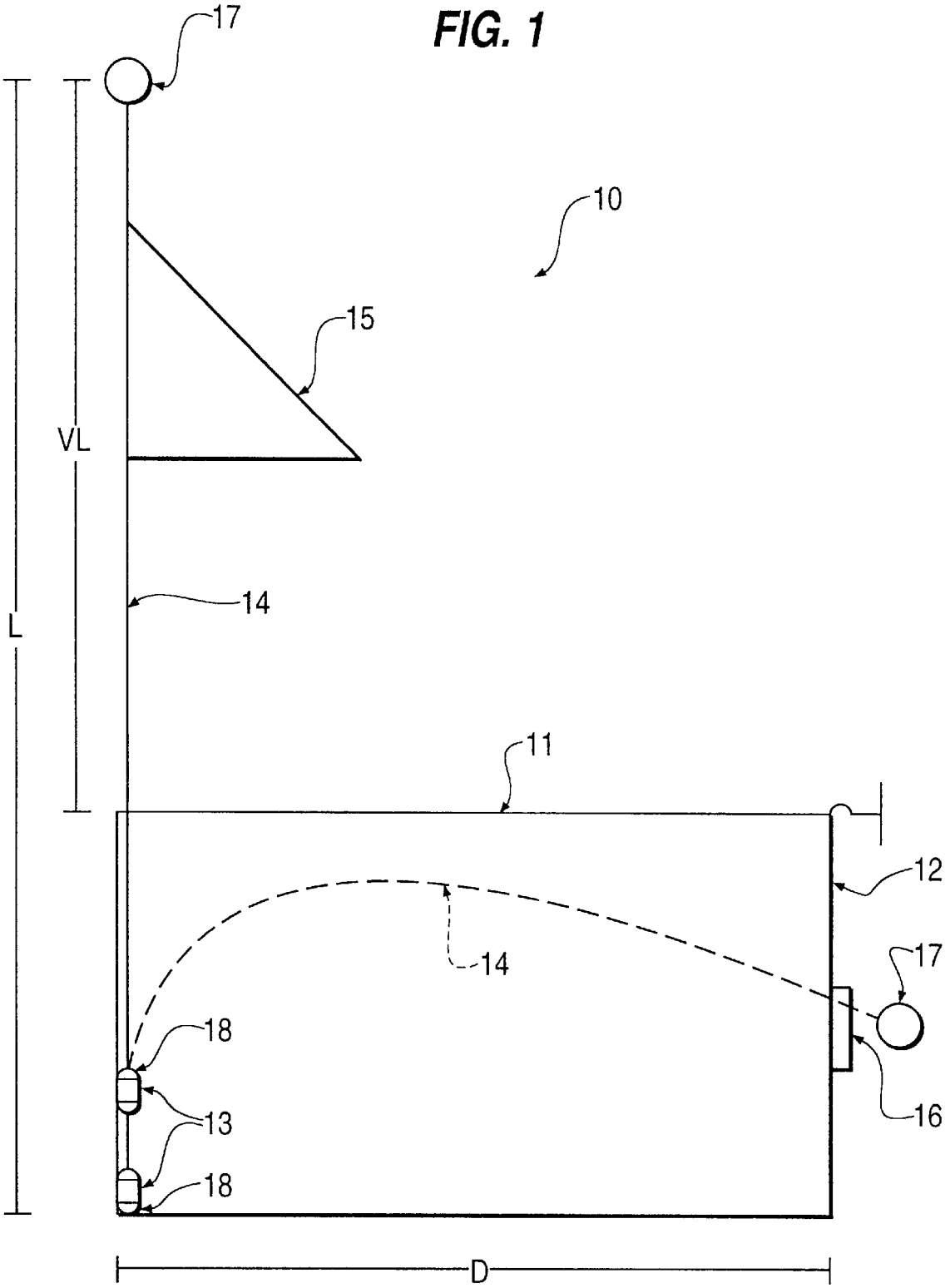
FIG. 1 schematically depicts a side view of the system for visually indicating the delivery of mail.
Figure 2:
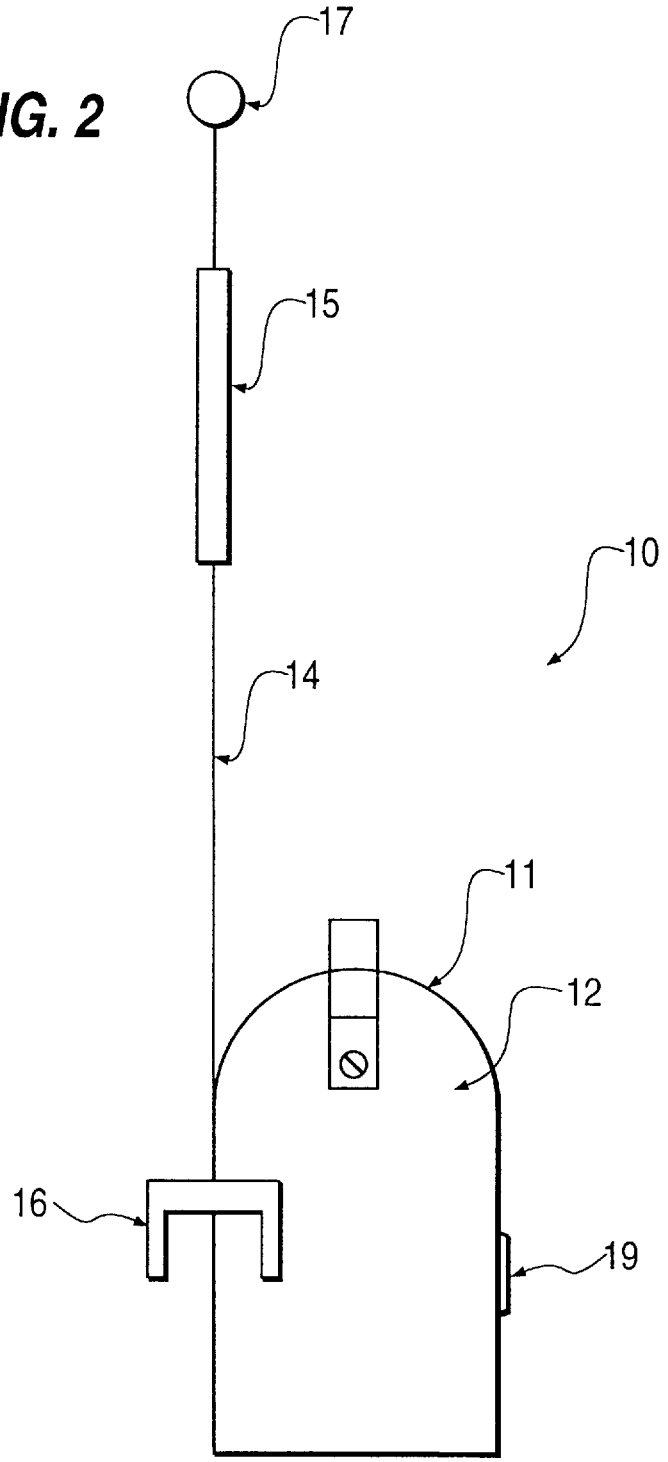
FIG. 2 schematically depicts a front view of the system for visually indicating the delivery of mail.
Figure 3:
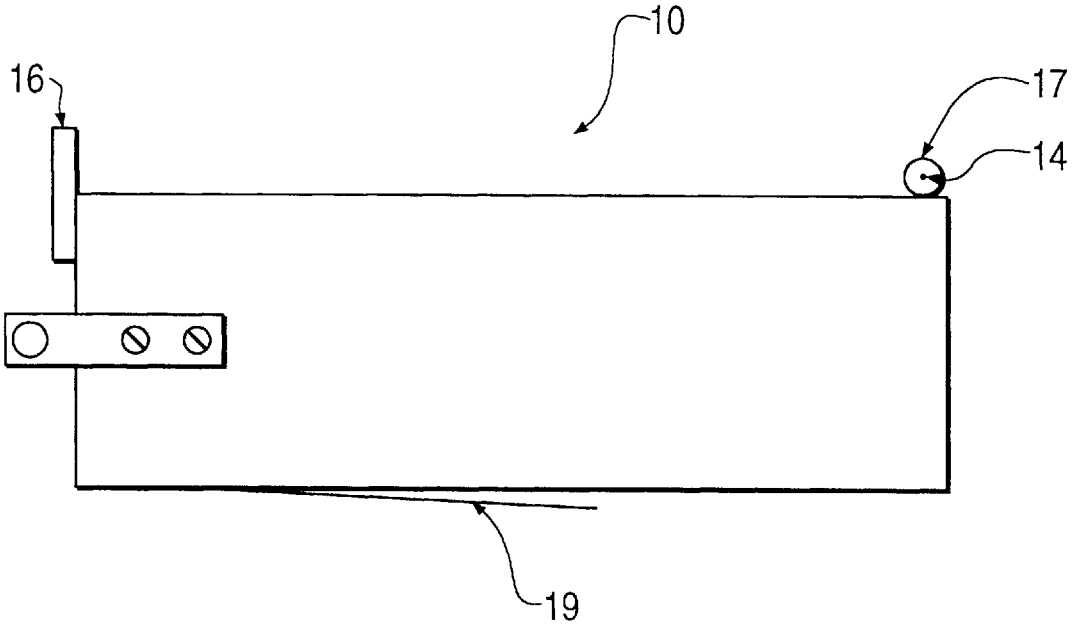
FIG. 3 schematically depicts a top view of the system for visually indicating the delivery of mail.

An embodiment of the present invention is shown in FIGS. 1–3. FIG. 1 is a side view, FIG. 2 is a front view and FIG. 3 is a top view of a system 10 for visually indicating the delivery of mail. System 10 comprises a container 11 for holding mail. Container 11 may be constructed in any shape and size and of any material. In a preferred embodiment the container has a cross section with an inverted U shape with a flat bottom and is constructed of metal. Container 11 has an enclosed rear end, an open front end (for the deposit of mail therein) and a depth. The depth of container 11, as used herein, is the distance between its front and rear ends and is depicted in FIG. 1 as the distance D. Container 11 is provided with a door 12 to cover the open front end.

System 10 includes an elongated member 14, which is mechanically mounted to the side of container 11 at its rear end. Elongated member 14 may be made of any resilient material which can be bent by application of a force for a period of days and still remember its unstressed shape. By way of example, piano wire with a diameter of about 0.05 inches has the necessary resiliency. In a preferred embodiment, elongated member 14 may be mounted to container 11 through the use of clamps 13 and bushings 18. Bushings 18 function to adapt the size of elongated member 14 to fit within clamps 13 and help ensure the secure mounting of elongated member 14 to the side of container 11. In one embodiment, hose clamps were used and were mounted to the container using a nut securing a bolt extending through the band of the clamp. Other methods of mounting, for instance a single elongated clamp, or threading the member through holes in the container may be used.

Figure 4A:
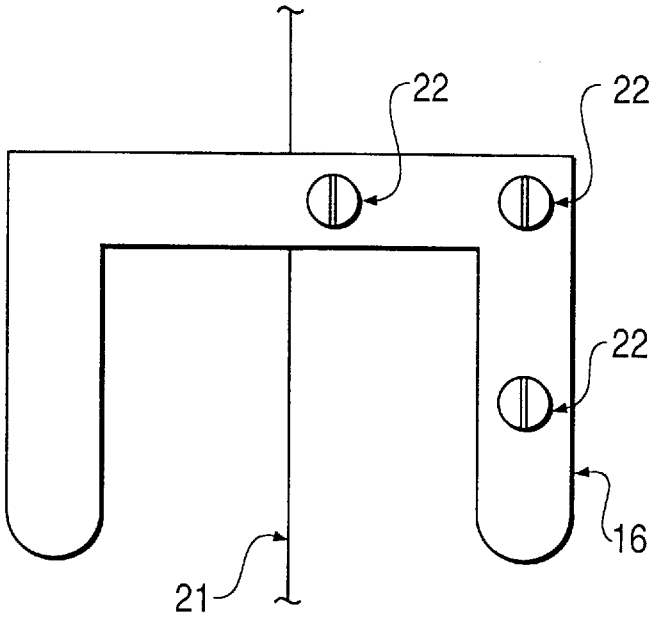
FIGS. 4*a* and 4*b* schematically depict the mounting of the engagement member to the container door.
Figure 4B:
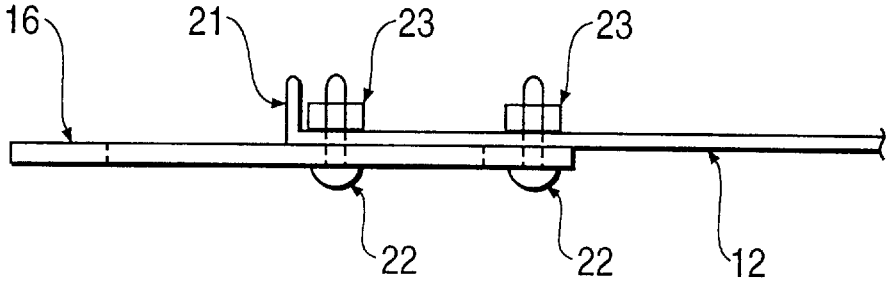

An engagement member 16 is mechanically mounted to the door of container 11. The mounting can be accomplished through the use of inter alia, nuts and bolts, screws, welding or adhesives. FIGS. 4*a* and 4*b* show a preferred embodiment of engagement member 16 and its mounting to door 12 in more detail. In FIGS. 4, engagement member 16 is shown as being a U-shaped metal bracket mounted adjacent edge 21 of door 12 using nuts 23 and bolts 22. Engagement member 16 is used to engage the second end of elongated member 14 when system 10 is in operation (explained in greater detail in conjunction with FIGS. 5*a–c*). Other configurations could be used for engagement member 16, e.g. a hook or a loop.

A visual signal 15 is mounted to elongated member 16 adjacent its second end. Visual signal 15 can be any highly visible signal and, in a preferred embodiment, is a flag or pennant and is preferably brightly colored to provide high visibility from a distance. The flag or pennant may be constructed of any suitable material, but in a preferred embodiment is constructed of laminated contact paper so as to be weather-proof. A tip protector 17 (explained in more detail with respect to FIGS. 6*a–c*) is provided to cover the second end of elongated member 14 to help ensure that elongated member 14 has a blunt end thereby decreasing the risk of injury to persons in the vicinity of system 10 while the system is in operation.

Although elongated member 14 has been shown and described as mounted to a side of container 11, in other embodiments it may be mounted to other locations on container 11, e.g. on the back of container 11 or on the top of container 11. Elongated member 14 should be mounted so that when it is in its unstressed, straight configuration, it is generally perpendicular to the depth of container 11 and is thereby in a highly visible position. The position of engagement member 16 is adjusted to correspond with the position of elongated member 14.

Figure 5A:
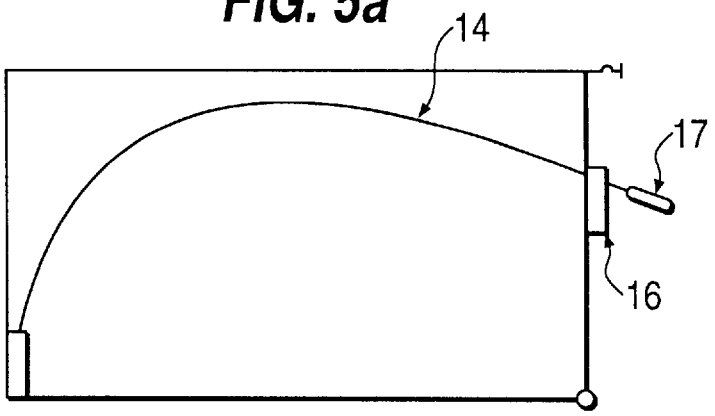
FIGS. 5*a*, 5*b* and 5*c* schematically depict the disengagement of the elongated member from the engagement member.
Figure 5B:
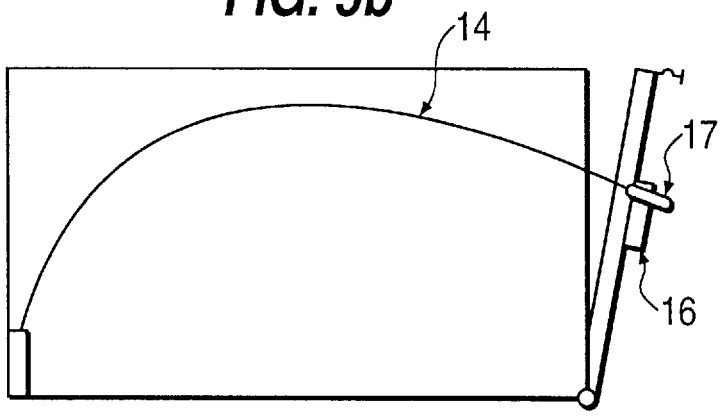
Figure 5C:
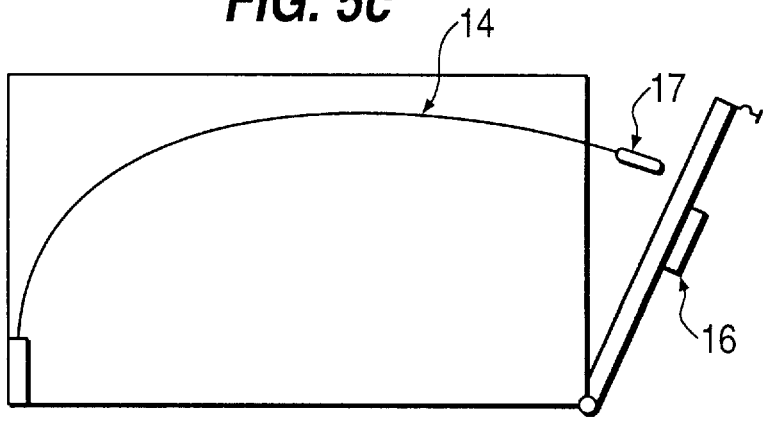

Operation of system 10 will now be explained in conjunction with FIGS. 5*a–c*. In an initial step, system 10 is set for operation by its owner. This is done by applying a force to elongated member 14's second end so as to bend elongated member 14 so that it is disposed substantially parallel to the depth of container 11 and so elongated member 14's second end engages with engagement member 16 mounted on door 12. Engagement member 16 restrains the movement of the second end of elongated member 14 and thereby continues the application of force. The second end of elongated member 14 is thereby held by engagement member 16 and elongated member 14 remains in a position substantially parallel to the depth of container 11. This engaged state is depicted in FIG. 5*a* and in FIG. 1 by the dashed-line representation of elongated member 14. In this state, system 10 indicates that the mail has not yet been delivered. In the next step, when the mail arrives, the mail carrier will open door 12 of the container to deposit the mail. When this occurs engagement member 16 swings down with door 12 and the second end of elongated member 14 is disengaged from engagement member 16, i.e. the second end of elongated member 14 slips out of the hold of engagement member 16. FIG. 5*b* shows the system as the door of the container begins to open and elongated member 14 begins to disengage. In this state, elongated member 14 has begun to slip out from under engagement member 16 and only tip protector 17 remains held by engagement member 16. FIG. 5*c* shows the system in the state just after the elongated member has disengaged from engagement member 16, the force on the second end of elongated member 14 thereby being removed. Because elongated member 14 is made of resilient material, when its second end fully disengages from engagement member 16, as shown in FIG. 5*c*, it will return to its straight configuration and swing up to its extended position. In this extended state, the visual indicator provides a highly visible signal that mail has arrived.

According to the embodiment described above, elongated member 14 is formed of any resilient material. However, the tip of elongated member 14's second end may have a dangerous, e.g., a sharp or jagged edge. Such a dangerous edge could cause injury to someone standing nearby system 10 while it is in operation. Further, second end of elongated member 14 should be kept clear so that elongated member 14 may properly disengage from engagement member 16 when door 12 is opened. The inventor has found that a properly sized tip protector 17 provides a blunt end to elongated member 12 to prevent injury and does not interfere with the disengaging of elongated member 14 from engagement member 16. The size of tip protector 17 shown in FIGS. 1–3 is exaggerated for purposes of illustration.

Figure 6A:
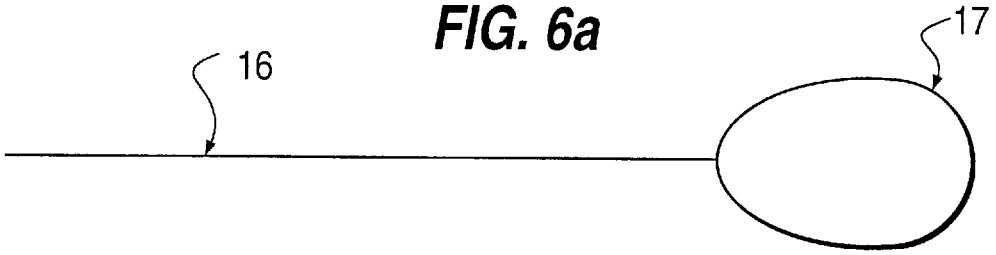
FIGS. 6*a*, 6*b* and 6*c* depict exemplary forms for the tip protector.
Figure 6B:
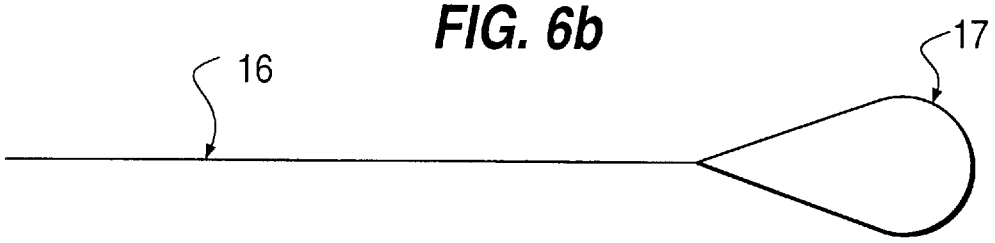
Figure 6C:
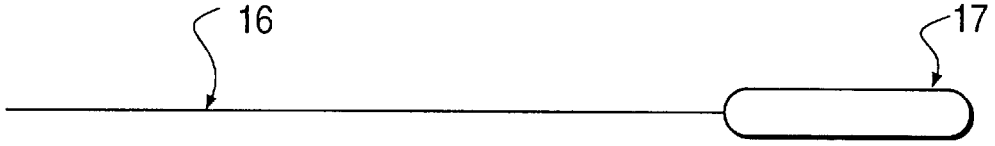

FIGS. 6*a–c* show tip protector 17 in more detail. Tip protector 17 should be shaped and sized so as not to interfere with the disengaging of elongated member 14 from engagement member 16. The shape is preferably a "soft" shape, i.e., a shape with no sharp edges. If tip protector 17 were to have sharp edges, it is possible that it could catch on engagement member 16 in the state shown in FIG. 5*b* and thereby prevent full disengagement and opening of the door. FIGS. 6*a–c* show three examples of soft shapes suitable for the tip protector 17. FIG. 6*a* shows tip protector 17 having a substantially elliptical shape. FIG. 6*b* shows tip protector 17 having a substantially tear-drop shape. FIG. 6*c* shows tip protector 17 having a substantially cylindrical shape with rounded edges. Note that all of these shapes have soft edges and thereby substantially reduce the possibility of injury due to sharp or jagged edges. Tip protector 17 will have a sufficiently small diameter so as not to interfere with the disengaging of elongated member 14 from engagement member 16. The particular size will depend on the particular shape chosen.

The material used for tip protector 17 should be relatively elastic and weather-proof. The material should be elastic so that if the second end of elongated member 14 did strike someone, it would not cause injury. The material chosen should be resistant to inter alia, water, wind, extreme temperatures and ultra-violate radiation. By way of example, some suitable materials would be thermoplastics and thermo-setting plastics. In one embodiment epoxy was used.

The embodiment outlined above also provides a highly visible mail signal. In the visual indicator system it is desirable to have elongated member 14 as long as possible to provide greater visibility. However, the size of elongated member 14 is limited by the depth D of container 11. This is so because while elongated member 14 is in its engaged position, it's second end should not extend too far past the front of container 11. If the end of elongated member 14 extends too far beyond the front of container 11, it may interfere with passersby. By mounting elongated member 14 as far back on container 11 as possible, the present invention allows the overall length L of elongated member 14 to be as large as possible and consequently allows a visible length, VL, of elongated member 14 extending above container 11 to be as great as possible. Further, the setup of the visual indicator shown in FIG. 1 allows the length L of the elongated member 14 to be greater than the depth, D, of container 11. The material used for elongated member 14 is sufficiently resilient to be significantly bent and still "remember" the straight configuration of its unstressed state. Therefore, when elongated member 14 is in its engaged position it has a significant bow to it as can be seen from the dotted version in FIG. 1. This bow allows elongated member 14 to be made longer than the depth of container 11 and still not have it's second end extend too far beyond the front of container 11. Consequently, the visible length VL is increased.

Although a detailed description of the present invention has been provided, it should be understood that the scope of the invention is not to be limited thereby, but is to be determined by the claims which follow. Various modifications and alternatives will be readily apparent to one of ordinary skill in the art.

I claim:

1. A system for visually indicating a delivery of mail comprising:

a container for holding mail including a front end, and a rear end, the front end being open and having a door to cover the front end, the container having a depth defined as the distance between the front end and rear end;

a resilient elongated member having a first end and a second end and a straight configuration in an unstressed state, the first end being mounted to the container at the rear end so that the elongated member extends substantially perpendicular to the depth of the container when the elongated member is in the unstressed state, said elongated member having a length greater than the depth of the container;

a visual indicator mounted adjacent the second end of the elongated member;

an engagement member mounted on the door, operative to hold the second end of the elongated member; and, a tip protector affixed to the second end of the elongated member, said tip protector having a shape with no sharp edges and comprising an elastic material;

wherein the elongated member is disposed in either an engaged position, where a force is applied to the second end of the elongated member by the engagement member thereby holding the second end so that the elongated member is substantially parallel to the depth of the container, or an extended position, where the elongated member is in the unstressed state and extends substantially perpendicular to the depth of the container;

wherein opening of the door causes the engagement member to move with the door away from the container and thereby causes the second end of the elongated member to slip out of a hold of the engagement member allowing the elongated member to return to the unstressed state and swing from the engaged position to the extended position;

wherein the tip protector provides a blunt end to said elongated member thereby preventing injury which might be caused by the second end of said elongated member when said elongated member swings from said engaged position to said extended position;

wherein the tip protector is sized sufficiently large to help prevent the elongated member from disengaging from the engagement member while the door of the container is closed and is sized sufficiently small so as not to prevent the second end of the elongated member from slipping out of the hold of the engagement member.

2. The system of claim 1 wherein the elongated member comprises a piece of resilent wire, said piece of resilent wire having a lenght greater than the depth of the container.

3. The system of claim 2 wherein the piece of resilent wire comprises piano wire with a diameter of about 0.05 inches.

4. The system of claim 1 wherein the tip protector comprises an elastic weather-proof material adhesively affixed to the second end of the elongated member.

5. The system of claim 1 wherein the container has at least one side and wherein the elongated member is mounted to a side of the container using first and second clamps and first and second bushings, the first end of the elongated member being clamped by the first and second clamps through the bushings.

6. The system of claim 1 wherein the engagement member comprises a U-shaped bracket.

7. The system of claim 1 wherein the visual indicator comprises a weather-proof flag mounted adjacent the second end of the elongated member.

8. The system of claim 7 wherein the flag comprises laminated contact paper adhesively affixed adjacent the second end of the elongated member.

9. An apparatus for holding mail and visually indicating an arrival of mail comprising: a container for holding mail including a front end and a rear end, the front end being open and having a door to cover the front end, the container having a depth defined as the distance between the front end and rear end;

a resilient elongated member having a first end and a second end and having a straight configuration in an unstressed state, the first end being mounted to the container at the rear end so that the elongated member extends substantially perpendicular to the depth of the container when the elongated member is in the unstressed state, said elongated member having a length greater than the depth of the container;

a visual indicator mounted adjacent the second end of the elongated member;

an engagement member mounted on the door, operative to apply a force to the second end of the elongated member and thereby hold the second end of the elongated member so that the elongated member is in a position substantially parallel to the depth of the container; and, a tip protector affixed to the second end of the resilient elongated member, said tip protector having a shape with no sharp edges and comprising an elastic material;

wherein opening the door of the container while the second end of the elongated member is held by the engagement member causes the second end of the elongated member to slip from the hold of the engagement member;

wherein the tip protector is sized sufficiently large to help prevent the elongated member from disengaging from the engagement member while the door of the container is closed and is sized sufficiently small so as not to prevent the second end of the elongated member from slipping out of the hold of the engagement member.

10. The apparatus of claim 9 wherein the elongated member comprises a piece of resilient wire.

11. The apparatus of claim 10 wherein the piece of resilient wire comprises piano wire having a diameter of about 0.05 inches.

12. The apparatus of claim 9 wherein the tip protector comprises weather-proof elastic material adhesively affixed to the second end of the elongated member.

13. The apparatus of claim 9 wherein the container has at least one side and wherein the elongated member is mounted to one side of the container through the use of first and second clamps and first and second bushings, the first and second clamps clamping the first end of the elongated member through the first and second bushings.

14. The apparatus of claim 9 wherein the engagement member comprises a U-shaped bracket.

15. The apparatus of claim 9 wherein the visual indicator comprises a weather-proof flag mounted adjacent the second end of the elongated member.

16. The apparatus of claim 15 wherein the flag comprises laminated contact paper adhesively affixed adjacent the second end of the elongated member.

* * * * *